US009728928B2

(12) United States Patent
Yoshigi

(10) Patent No.: US 9,728,928 B2
(45) Date of Patent: Aug. 8, 2017

(54) CONNECTOR AND METHOD FOR PRODUCING THE SAME

(71) Applicant: YAZAKI CORPORATION, Tokyo (JP)

(72) Inventor: Toshimasa Yoshigi, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/083,547

(22) Filed: Mar. 29, 2016

(65) Prior Publication Data

US 2016/0294103 A1 Oct. 6, 2016

(30) Foreign Application Priority Data

Mar. 30, 2015 (JP) ..... 2015-069102

(51) Int. Cl.

| | |
|---|---|
| ***H01R 13/52*** | (2006.01) |
| ***H01R 43/20*** | (2006.01) |
| ***H01R 43/00*** | (2006.01) |
| ***H01R 13/03*** | (2006.01) |
| ***H01R 13/41*** | (2006.01) |

(52) U.S. Cl.

CPC ..... *H01R 43/20* (2013.01); *H01R 13/03* (2013.01); *H01R 13/41* (2013.01); *H01R 13/521* (2013.01); *H01R 43/005* (2013.01)

(58) Field of Classification Search

CPC .... H01R 12/585; H01R 13/05; H01R 13/428; H01R 13/5202; H01R 13/5219; H01R 33/965

USPC ..... 439/271, 587, 82, 751

See application file for complete search history.

(56) References Cited

U.S. PATENT DOCUMENTS

| | | | | |
|---|---|---|---|---|
| 8,187,007 | B2 * | 5/2012 | Emde | H01R 12/585 439/751 |
| 8,444,444 | B2 * | 5/2013 | Kitajima | H01R 13/41 439/751 |
| 9,515,407 | B2 * | 12/2016 | Ohyama | H01R 13/41 |

(Continued)

FOREIGN PATENT DOCUMENTS

| | | | | |
|---|---|---|---|---|
| JP | 2-75429 | A | 3/1990 | |
| JP | H09245880 | * | 9/1997 | H01R 13/04 |

(Continued)

OTHER PUBLICATIONS

Japanese Office Action for the related Japanese Patent Application No. 2015-069102 dated Mar. 10, 2017.

*Primary Examiner* — Abdullah Riyami
*Assistant Examiner* — Thang Nguyen
(74) *Attorney, Agent, or Firm* — Kenealy Vaidya LLP

(57) ABSTRACT

A connector includes a resin housing, a terminal and a seal member. The housing includes a housing body and a partition portion that divides inside of the housing body, a press-fit hole being provided in the partition portion so as to penetrate the partition portion from a front face to a rear face of the partition portion being opposed to the front face. The terminal includes a conductive metal portion and a plated layer surrounding the conductive metal portion, the terminal being press-fitted into the press-fit hole, and an intermediate portion of the terminal being fixed to the partition portion. The seal member covers at least one of the front face and the rear face of the partition portion and is adhere to the partition portion and the terminal so as to seal the press-fit hole.

11 Claims, 4 Drawing Sheets

(56) References Cited

U.S. PATENT DOCUMENTS

| | | | | |
|---|---|---|---|---|
| 2004/0242082 | A1* | 12/2004 | Tsuchiya | H01R 12/585 439/751 |
| 2009/0117755 | A1* | 5/2009 | Tonosaki | H01R 13/41 439/55 |
| 2010/0297864 | A1* | 11/2010 | Matsuoka | B29C 45/14639 439/271 |
| 2011/0053398 | A1* | 3/2011 | Arai | H01B 7/285 439/271 |
| 2015/0194762 | A1 | 7/2015 | Fukuda et al. | |

FOREIGN PATENT DOCUMENTS

| | | | |
|---|---|---|---|
| JP | 2012-84444 | A | 4/2012 |
| JP | 2014-60099 | A | 4/2014 |
| JP | 2014-127429 | A | 7/2014 |
| WO | 2014/046109 | A1 | 3/2014 |

* cited by examiner

CONNECTOR AND METHOD FOR PRODUCING THE SAME

CROSS REFERENCE TO RELATED APPLICATIONS

This application is based on Japanese Patent Application (No. 2015-069102) filed on Mar. 30, 2015, the contents of which are incorporated herein by reference.

BACKGROUND OF THE INVENTION

1. Field of the Invention

The present invention relates to a connector and a method for producing the same.

2. Description of the Related Art

For example, in a relay connector for electrically connecting an electrical component inside a transmission to a device such as a power supply or a control device outside the transmission so as to relay therebetween, sealing performance is required to prevent oil inside the transmission from invading a connector fitting portion.

Such a relay connector has a housing and a relay terminal provided in the housing, and the housing is filled with a seal member so as to secure sealing performance between the housing and the relay terminal (for example, see JP-A-2014-127429 and JP-A-2014-60099).

In a relay connector disclosed in JP-A-2014-127429, a relay terminal is provided integrally with a housing by insert molding. Therefore, large-scaled molding equipment is required for insert molding of the relay terminal. The equipment cost increases.

In a relay connector disclosed in JP-A-2014-60099, a relay terminal is press-fitted into a through hole formed in a housing. Large-scaled molding equipment for insert molding is not required. However, the relay terminal used in the relay connector is made of a metal plate punched out by pressing. In the relay terminal formed thus by pressing, an unplated rupture surface is formed so that uneven adhesion to a seal member may lead to deterioration in sealing performance or deterioration in corrosion resistance. Therefore, the technique disclosed in JP-A-2014-60099 needs a troublesome post-plating step in which a relay terminal formed by pressing is washed and then subjected to plating. In addition, since the relay terminal is formed out of a metal plate punched out by pressing, the yield thereof is low, and adhesion to a seal member is uneven due to occurrence of sagging, burrs, etc. Thus, reliability in connection to a mating terminal may also deteriorate.

SUMMARY OF THE INVENTION

The present invention has been developed in consideration of the aforementioned circumstances. An object of the invention is to provide a high-quality connector and a method for producing the same, capable of being produced easily while suppressing the equipment cost and improving the yield, and capable of obtaining good sealing performance and high connection reliability.

In order to attain the aforementioned object, connectors according to the invention are characterized by the following items (1) to (9).

(1) A connector comprising:

a housing made of resin, the housing comprising:

a housing body; and a partition portion that is provided in the housing body and divides inside of the housing body, a press-fit hole being provided in the partition portion so as to penetrate the partition portion from a front face to a rear face of the partition portion being opposed to the front face;

a terminal having a rod-like shape and comprising a conductive metal portion and a plated layer surrounding the conductive metal portion, the terminal being press-fitted into the press-fit hole, an intermediate portion of the terminal being fixed to the partition portion; and a seal member configured to cover at least one of the front face and the rear face of the partition portion and adhere to the partition portion and the terminal so as to seal the press-fit hole.

(2) The connector according to the item (1), wherein the seal member covers a surface of the partition portion, a part of a periphery face of the press-fit hole continuing from the surface of the partition portion, and a surface of the plated layer of the terminal facing to the part of the periphery face of the press-fit hole.

(3) The connector according to the item (1) or (2), wherein a fixing protrusion is provided on an intermediate portion of the terminal and protrudes outward so that the terminal is fixed to the partition portion.

(4) The connector according to the item (3), wherein the fixing protrusion bites into a periphery face of the press-fit hole.

(5) The connector according to any one of the items (1) to (3), wherein the housing body has a tubular shape;

wherein the housing body has a first inner space and a second inner space which are divided by the partition portion;

wherein the housing body comprises:

a first fitting concave portion having the partition portion and a first periphery portion surrounding the first inner space; and a second fitting concave portion having the partition portion and a second periphery portion surrounding the second inner space; and wherein end portions of the terminal protruding from the partition portion are disposed in the first fitting concave portion and the second fitting concave portion respectively.

(6) The connector according to the item (5), wherein the partition portion, the first periphery portion, and the second periphery portion are configured by a unitary piece.

According to the above configurations, the terminal is press-fitted into the press-fit hole of the partition portion of the housing, and fixed thereto. Accordingly, the connector can be produced easily without using any large-scaled molding equipment so that the equipment cost can be suppressed, as compared with a connector in which a terminal is integrated with a housing by insert molding.

Further, the terminal fixed to the housing is formed as follows. That is, a long wire made of a conductive metal material subjected to plating in advance is cut into predetermined length. Accordingly, the yield can be improved as compared with a case where a terminal formed by pressing is used. In addition, no unplated rupture surface is formed. It is therefore possible to secure high resistance against corrosion and high reliability in connection to a mating terminal without performing troublesome post-plating or chamfering. Thus, high quality can be secured.

In addition, there is no sagging or burrs in the terminal made of the metal conductor subjected to plating in advance, and plating is applied uniformly all over the circumference of the metal conductor of the terminal. Accordingly adhesion to the seal member around the terminal can be made so uniform that good sealing performance can be secured.

In the connector, the terminal is press-fitted into the press-fit hole so that the fixing protrusion can bite into the inner surface of the press-fit hole. It is therefore possible to enhance the fixing strength of the terminal to the partition portion. As a result, it is possible to suppress the terminal from fluctuating when an external force acts on the terminal, and it is possible to keep a good adhesion state between the seal member and the terminal. Thus, good sealing performance can be secured.

In the connector, mating connectors are fitted to the fitting concave portions of the housing respectively so that terminals of the mating connectors can be electrically connected to each other through the terminal fixed to the partition portion. In addition, sealing can be achieved between the fitting concave portions by the seal member.

In addition, in order to attain the aforementioned object, a method for producing a connector according to the invention is characterized by the following methods (7) to (9).

(7) A method for producing a connector, comprising:

forming a terminal by cutting an elongated metal conductor subjected to plating with a predetermined length;

press-fitting the terminal into a press-fit hole of a partition portion of a housing body of a housing to fix an intermediate portion of the terminal to the partition portion of the housing body, wherein the housing is made of resin and comprises the housing body and the partition portion that divides inside of the housing body, and the press-fit hole is provided in the partition portion so as to penetrate the partition portion from a front face to a rear face of the partition portion being opposed to the front face; and filling a seal material into the housing body so as to cover at least one of the front face and the rear face of the partition portion, and then the filled seal material is hardened and formed into a seal member and adhered the seal member to the partition portion and the terminal so as to seal the press-fit hole.

(8) The method according to the item (7), wherein the seal member covers a surface of the partition portion, a part of a periphery face of the press-fit hole continuing from the surface of the partition portion, and a surface of the plated layer of the terminal facing to the part of the periphery face of the press-fit hole.

(9) The method according to item (7) or (8), wherein a fixing protrusion is provided on an intermediate portion of the terminal and protrudes outward so that the terminal is fixed to the partition portion.

According to the above methods, it is possible to easily manufacture a high-quality connector obtaining good sealing performance and high connection reliability while suppressing the equipment cost and improving the yield.

According to the invention, it is possible to provide a high-quality connector and a method for producing the same, capable of being produced easily while suppressing the equipment cost and improving the yield, and capable of obtaining good sealing performance and high connection reliability.

The invention has been described briefly. Further, the details of the invention will be made clearer through the following mode for carrying out the invention (hereinafter referred to as "embodiment") with reference to the accompanying drawings.

BRIEF DESCRIPTION OF THE DRAWINGS

FIG. 1A is a sectional view of the connector, and FIG. 1B is an enlarged view of a portion A in FIG. 1A.

FIG. 3A is a perspective view of the rod-like terminal, and FIG. 3B is an enlarged view of a portion B in FIG. 3A.

DETAILED DESCRIPTION OF THE EXEMPLARY EMBODIMENTS

An embodiment of the invention will be described below with reference to the drawings by way of example.

Figure 1A:
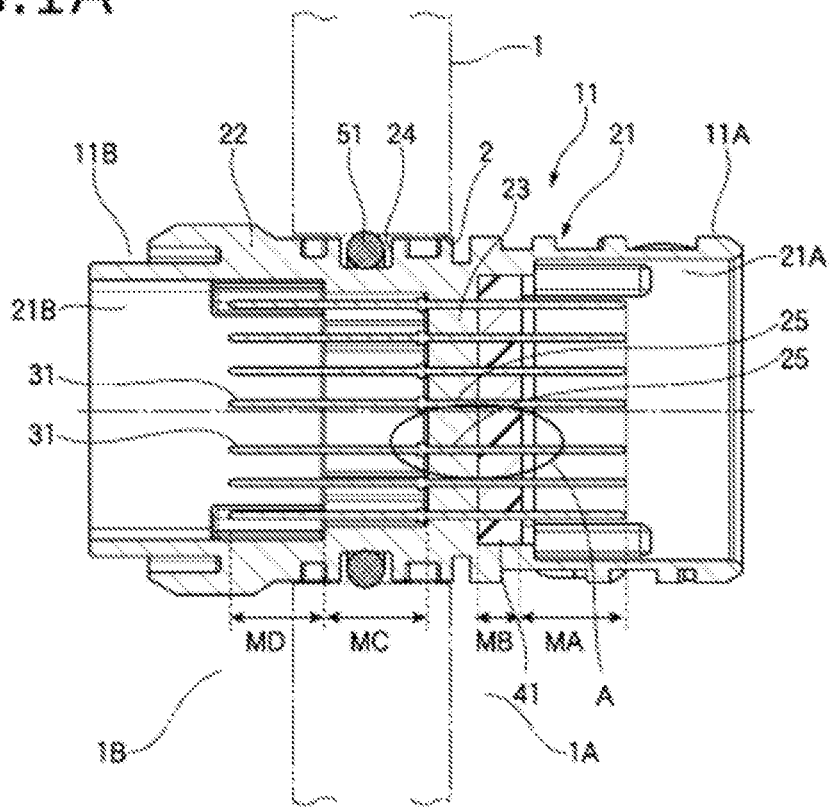
FIGS. 1A and 1B are views showing a connector according to an embodiment.
Figure 1B:
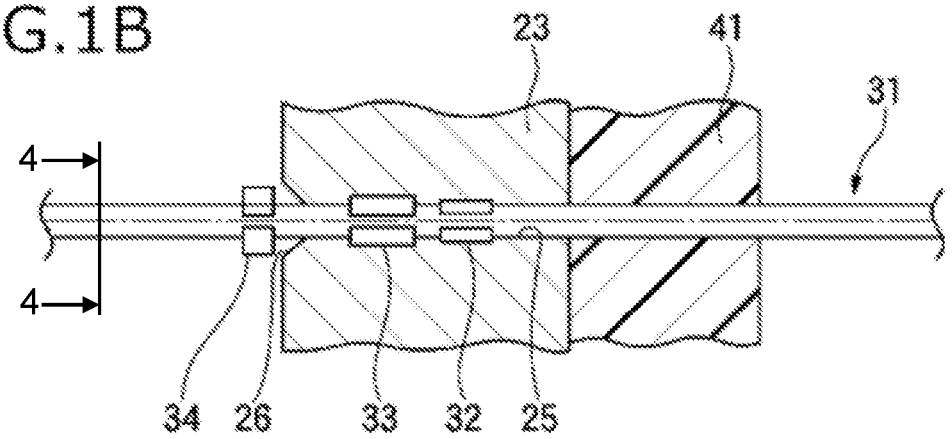

FIG. 1 are views showing a connector according to the embodiment. FIG. 1A is a sectional view of the connector, and FIG. 1B is an enlarged view of a portion A in FIG. 1A.

As shown in FIG. 1A, a connector 11 according to the embodiment is, for example, attached to a transmission case 1 receiving a transmission for a vehicle. The connector 11 is a relay connector to be used for connection between a device such as a power supply or a control device disposed in a case outside 1A of the transmission case 1 and an electric component received in a case inside 1B. The connector 11 is fitted into a mounting hole 2 formed in the transmission case 1 so as to be attached to the transmission case 1. The opposite ends of the connector 11 are formed as connection portions 11A and 11B. Mating connectors are connected to the connection portions 11A and 11B respectively. When the connector 11 is attached to the transmission case 1, the connection portion 11A is disposed on the case outside 1A side, and the connection portion 11B is disposed on the case inside 1B side.

The connector 11 has a housing 21 and a plurality of rod-like terminals 31. In addition, a seal member 41 is filled into the connection portion 11A side of the connector 11.

Figure 2:
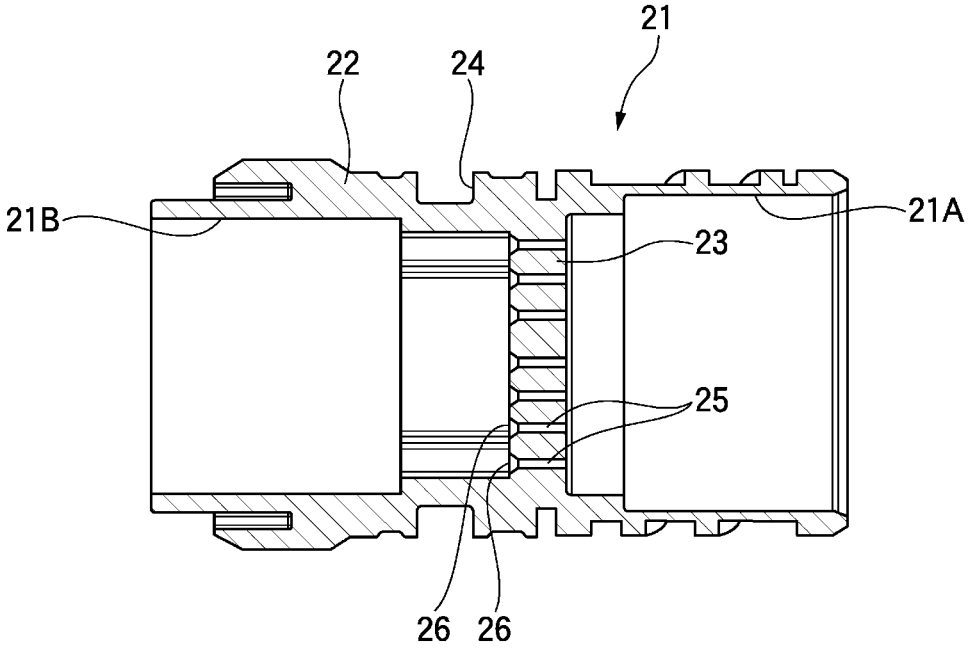
FIG. 2 is a sectional view of a housing constituting the connector according to the embodiment.

FIG. 2 is a sectional view of the housing constituting the connector according to the embodiment.

As shown in FIG. 2, the housing 21 has a housing body 22 and a partition portion 23. The housing 21 is formed by injection molding out of synthetic resin having insulating properties, such as polyphenylene sulfide (PPS) resin containing glass fiber. The housing body 22 is formed into a cylindrical shape. The partition portion 23 is formed in an axially intermediate portion inside the housing body 22. The inside of the housing body 22 is divided axially by the partition portion 23. Thus, fitting concave portions 21A and 21B formed by the housing body 22 and the partition portion 23 are formed in the housing 21. Housings of the mating connectors are fitted into the fitting concave portions 21A and 21B respectively. In addition, in the housing 21, a reception groove 24 is formed in the outer circumference of the axially intermediate portion so as to extend circumferentially.

A plurality of press-fit holes 25 are formed in the partition portion 23 so as to penetrate the partition portion 23 from its front side to its back side. The rod-like terminals 31 are press-fitted into the press-fit holes 25 from one side, that is, from the fitting concave portion 21B side. In an edge portion of each press-fit hole 25 on the one side, that is, on the fitting concave portion 21B side, a guide portion 26 is formed to be narrowed gradually toward the other fitting concave portion 21A (see FIG. 1B. When the rod-like terminal 31 press-fitted into the press-fit hole 25 is brought into contact with the guide portion 26, the guide portion 26 guides the rod-like terminal 31 to the center of the press-fit hole 25. The press-fit hole 25 is a square hole having a rectangular shape in sectional view. The press-fit hole 25 is formed into substantially the same sectional shape as the outer shape of the rod-like terminal 31.

Figure 3A:
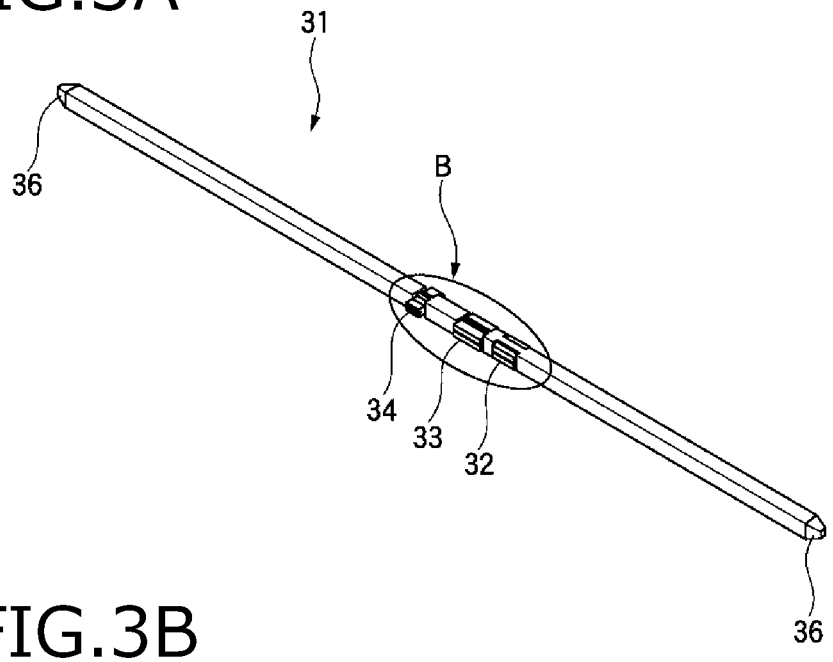
FIGS. 3A and 3B are views showing a rod-like terminal constituting the connector according to the embodiment.
Figure 3B:
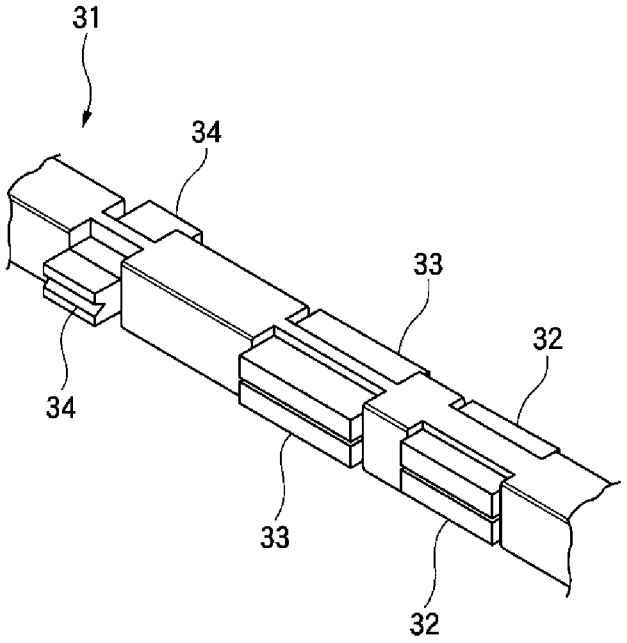

FIG. 3 are views showing the rod-like terminal constituting the connector according to the embodiment. FIG. 3A is a perspective view of the rod-like terminal, and FIG. 3B is an enlarged view of a portion B in FIG. 3A.

Figure 4:
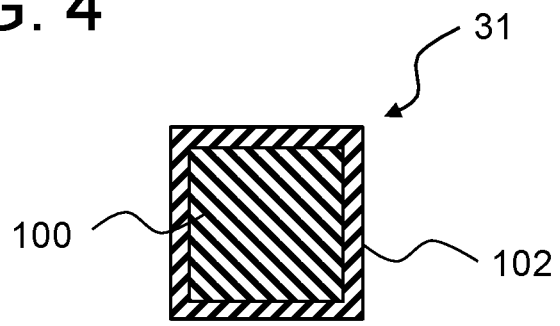
FIG. 4 is a cross-sectional view taken along 4-4 in FIG. 1B.

As shown in FIG. 3A, each rod-like terminal 31 is formed like a rod having a rectangular shape in sectional view. As shown in FIG. 4, the rod-like terminal 31 is formed out of a conductive metal material 100 such as copper or a copper alloy. The rod-like terminal 31 includes a plated layer 102 that is applied uniformly all over the four circumferential surfaces of the rod-like member 31. The rod-like terminal 31 is, for example, plated with tin on a copper base by pre-plating. The rod-like terminal 31 is formed out of a long square wire subjected to the pre-plating in advance and cut into predetermined length. As shown in FIG. 3B, fixing protrusions 32 and 33 and a locking dowel 34 are formed in an intermediate portion of the rod-like terminal 31 so as to protrude outward. In addition, taper portions 36 each having a tapered shape are formed in opposite end portions of the rod-like terminal 31 so that the taper portions 36 can be smoothly guided into female terminals of mating connectors respectively when the rod-like terminal 31 is connected to the female terminals. The fixing protrusions 32 and 33, the locking dowel 34 and the taper portions 36 are formed when the long square wire is cut into predetermined length.

As shown in FIG. 1B, the rod-like terminals 31 are press-fitted into the press-fit holes 25 formed in the partition portion 23 of the housing 21 by a press-fitting machine. Thus, the intermediate portions of the rod-like terminals 31 are fixed to the partition portion 23, and the opposite end portions of each rod-like terminal 31 are disposed in the fitting concave portions 21A and 21B of the housing 21. The rod-like terminal 31 is pressed from the fitting concave portion 21B side where the guide portion 26 of the press-fit hole 25 is formed, toward the fitting concave portion 21A side so that the fixing protrusion 32 can point forward. The press-fitting machine locks the locking dowel 34 and presses the rod-like terminal 31 into the press-fit hole 25. When the rod-like terminal 31 is press-fitted into the press-fit hole 25 of the partition portion 23, the two fixing protrusions 32 and 33 of the rod-like terminal 31 eat into the inner surface of the press-fit hole 25. Thus, the rod-like terminal 31 is fixed to the partition portion 23 surely. Incidentally, the locking dowel 34 is not press-fitted into the press-fit hole 25 but disposed on the fitting concave portion 21B side from the press-fit hole 25.

A seal member 41 is provided on the one side of the connector 11, that is, on the connection portion 11A thereof. A sealing material is filled, and then hardened on the fitting concave portion 21A side of the partition portion 23 from which the rod-like terminals 31 protrude to form the seal member 41. Thus, the seal member 41 covers the surface of the partition portion 23 so as to adhere to the housing 21 and the rod-like terminals 31. Due to the seal member 41, the press-fit holes 25 of the partition portion 23 from which the rod-like terminals 31 protrude are sealed off. For example, thermosetting resin such as silicon resin or epoxy resin is used as the seal material.

Next, a method for producing the aforementioned connector 11 will be described.

(Terminal Forming Step)

A long square wire subjected to plating is cut into predetermined length to form each rod-like terminal 31. Incidentally, on this occasion, the fixing protrusions 32 and 33, the locking dowel 34 and the taper portions 36 are formed in the rod-like terminal 31.

(Terminal Press-Fitting Step)

By use of a press-fitting machine, the rod-like terminals 31 are press-fitted into the press-fit holes 25 of the partition portion 23 of the housing 21 formed by injection molding. Thus, the intermediate portions of the rod-like terminals 31 are fixed to the housing 21, and the opposite ends of each rod-like terminal 31 are disposed within the fitting concave portions 21A and 21B of the housing body 22. When the rod-like terminals 31 are press-fitted into the press-fit holes 25, the fixing protrusions 32 and 33 of the rod-like terminals 31 eat into the inner surfaces of the press-fit holes 25. Thus, the rod-like terminals 31 are fixed to the partition portion 23 surely.

(Sealing Step)

The seal material is filled into the fitting concave portion 21A of the housing 21 so as to cover the surface of the partition portion 23. The seal material is heated and hardened. As a result, the seal member 41 is formed and is adheres to the partition portion 23 providing the fitting concave portion 21A of the housing 21, and a part of each rod-like terminal 31 protruding within the fitting concave portion 21A. In this manner, the press-fit holes 25 into which the rod-like terminals 31 have been pressed in the partition portion 23 are sealed off by the seal member 41. Thus, a sealing structure is formed.

The connector 11 produced thus is fitted into the mounting hole 2 of the transmission case 1 in the state where an O-ring 51 has been fitted into a reception groove formed in the outer circumference of the housing 21. Thus, the connector 11 is attached to the transmission case 1 in the state where sealing has been secured between the connector 11 and the transmission case 1 by the O-ring 51.

In this manner, a housing of a mating connector of a device such as a power supply or a control device in the case outside 1A is fitted to the fitting concave portion 21A of the housing 21 in the connector 11 attached to the transmission case 1 so that the mating connector can be connected to the connection portion 11A. On the other hand, a housing of a mating connector of an electric component received in the case inside 1B is fitted to the fitting concave portion 21B of the housing 21 so that the mating connector can be connected to the connection portion 11B. In this manner, the female terminals of the mating connectors are electrically connected to each other through the rod-like terminals 31 of the connector 11 so that the device in the case outside 1A and the electric component in the case inside 1B can be electrically connected to each other.

In the connector 11, the press-fit holes 25 into which the rod-like terminals 31 have been pressed in the partition portion 23 are sealed off by the seal member 41 so that sealing can be secured between the fitting concave portions 21A and 21B surely. Thus, oil in the transmission is prevented from leaking to the outside through the press-fit holes 25.

As described above, in the connector 11 according to the embodiment, the rod-like terminals 31 are press-fitted into the press-fit holes 25 of the partition portion 23 of the housing 21 and fixed thereto. Accordingly, the connector 11 can be produced easily without any large-scaled molding equipment so that the equipment cost can be suppressed, as compared with a connector in which rod-like terminals are integrated with a housing by insert molding.

Further, each rod-like terminal 31 fixed to the housing 21 is formed out of a long square wire made of a conductive metal material subjected to plating in advance and cut into predetermined length. Accordingly, the yield can be improved as compared with the case where rod-like terminals formed by pressing are used. In addition, no unplated rupture surface is formed. It is therefore possible to secure high resistance against corrosion and high reliability in connection to a mating terminal without performing troublesome post-plating or chamfering. Thus, high quality can be secured.

In addition, there is no sagging or burrs in each rod-like terminal 31 made of the square wire subjected to plating in advance, and plating is applied uniformly all over the four circumferential surfaces of the rod-like terminal 31. Accordingly adhesion to the seal member 41 around the rod-like terminal 31 can be made so uniform that good sealing performance can be secured.

In addition, each rod-like terminal 31 has the fixing protrusions 32 and 33 protruding outward in the intermediate portion fixed to the partition portion 23. Accordingly, when the rod-like terminal 31 is press-fitted into the press-fit hole 25, the fixing protrusions 32 and 33 of the rod-like terminal 31 can eat into the inner surface of the press-fit hole 25. It is therefore possible to enhance the fixing strength of the rod-like terminal 31 to the partition portion 23. As a result, it is possible to prevent the rod-like terminal 31 from fluctuating when an external force acts on the rod-like terminal 31, and it is possible to keep a good adhesion state between the seal member 41 and the rod-like terminal 31. Thus, good sealing performance can be secured.

In addition, the connector 11 according to the embodiment is a relay connector having the fitting concave portions 21A and 21B on the opposite end sides of the housing 21. When mating connectors are fitted into the fitting concave portions 21A and 21B respectively, terminals of the mating connectors can be electrically connected to each other through the rod-like terminals 31 fixed to the partition portion 23. In addition, sealing can be achieved between the fitting concave portions 21A and 21B by the seal member 41.

In the connector 11 made of a relay connector having the fitting concave portions 21A and 21B on the opposite end sides of the housing 21, as shown in FIG. 1A, a to-be-plated region MA, a to-be-plated region MB, a not-to-be-plated region MC and a to-be-plated region MD are arranged in each rod-like terminal 31 in order from the deeper side (right side in FIG. 1A) in a direction in which the rod-like terminal 31 is press-fitted into the press-fit hole 25 of the partition portion 23. The to-be-plated regions MA and MD on the opposite end sides of the rod-like terminal 31 are regions needing plated layers in order to secure electric properties for the sake of terminal connection to mating connectors. The to-be-plated region MB in the intermediate portion of the rod-like terminal 31 and on the deeper side in the press-fitting direction is a region needing a plated layer in order to secure adhesion to the seal member 41. The not-to-be-plated region MC in the intermediate portion of the rod-like terminal 31 and on the near side in the press-fitting direction is a region where there is no electric connection to the terminal of any mating connector and there is no sealing by the seal member 41. That is, the not-to-be-plated region MC is a region where there will arise no problem if a plated layer is separated. In the terminal press-fitting step, the rod-like terminal 31 configured thus is press-fitted into the press-fit hole 25 while the locking dowel 34 is held by a terminal holding chuck of the press-fitting machine. Although there is a fear on this occasion that plating may be separated in or near the locking dowel 34 due to the terminal holding chuck holding the locking dowel 34, the locking dowel 34 and its vicinities held by the terminal holding chuck belong to the not-to-be-plated region MC where there will arise no problem if the plated layer is separated. Therefore, no influence is given to the electric connection between the terminals or the adhesion to the seal member 41.

From above, the invention is useful for a connector in which the to-be-plated region MA, the to-be-plated region MB, the not-to-be-plated region MC and the to-be-plated region MD are arranged in each rod-like terminal 31 in order from the deeper side in the press-fitting direction, for example, for a relay connector in which connectors are fitted to the fitting concave portions 21A and 21B on the opposite sides and sealing is further secured by the seal material filled thereinto.

In addition, according to the method for producing the connector according to the embodiment, the connector 11 is produced as follows. That is, a long square wire made of a conductive metal material subjected to plating in advance is cut into predetermined length to form each rod-like terminal 31. The rod-like terminals 31 formed thus are press-fitted into the press-fit holes 25 of the partition portion 23 of the housing 21 and fixed thereto. The seal material is filled and hardened to cover one surface of the partition portion 23 so that the press-fit holes 25 can be sealed off by the seal member 41. It is therefore possible to easily manufacture the high-quality connector 11 obtaining good sealing performance and high connection reliability while suppressing the equipment cost and improving the yield.

Incidentally, although the rod-like terminals 31 having rectangular shapes in sectional view are press-fitted into the press-fit holes 25 made of square holes having rectangular shapes in sectional view in the aforementioned embodiment, rod-like terminals 31 having circular shapes in sectional view may be press-fitted into press-fit holes 25 made of round holes having circular shapes in sectional view. In this case, each rod-like terminal 31 is formed out of a long round wire cut into predetermined length.

In addition, the seal member 41 is not limited to one provided on the one side of the connector 11, that is, on the connection portion 11A side thereof, but may be provided on the other side of the connector 11, that is, on the connection portion 11B side, or may be provided on both the connection portions 11A and 11B.

In addition, although the connector 11 according to the embodiment has been described along an example of a relay connector in which mating connectors are connected from the opposite sides thereof, the invention may be applied to a connector in which a mating connector is connected on one end side and the other end side is mounted on a circuit board or the like.

Incidentally, the invention is not limited to the aforementioned embodiment, but suitable deformations, improvements and so on may be made thereon. In addition, materials, shapes, dimensions, numbers, arrangement places, etc. of constituent elements in the aforementioned embodiment are not limited but may be selected desirably if the invention can be attained.

Here, the aforementioned features of the embodiment of the connector and the method for producing the same according to the invention will be summarized and listed in the following paragraphs [1] to [4] respectively.

[1] A connector including:

a housing (21) made of resin, the housing (21) comprising:

a housing body (22); and a partition portion (23) that is provided in the housing body and divides inside of the housing body (22), wherein a press-fit hole (25) is provided in the partition portion (23) so as to penetrate the partition portion (23) from a front face to a rear face of the partition portion (23) being opposed to the front face;

a terminal (31) having a rod-like shape and comprising a conductive metal portion and a plated layer surrounding the conductive metal portion, the terminal (31) being press-fitted into the press-fit hole (25), and an intermediate portion of the terminal (31) being fixed to the partition portion (23); and a seal member (41) configured to cover at least one of the front face and the rear face of the partition portion (23) and adhere to the partition portion (23) and the terminal (31) so as to seal the press-fit hole (25).

[2] The connector according to item [1], wherein the seal member (41) covers a surface of the partition portion (23), a part of a periphery face of the press-fit hole (25) continuing from the surface of the partition portion (23), and a surface of the plated layer of the terminal (31) facing to the part of the periphery face of the press-fit hole (25).

[3] The connector according to item [1] or [2], wherein a fixing protrusion (32,33) is provided on an intermediate portion of the terminal (31) and protrudes outward so that the terminal (31) is fixed to the partition portion (23).

[4] The connector according to item [3], wherein the fixing protrusion (32,33) bites into a periphery face of the press-fit hole (25).

[5] The connector according to any one of items [1] to [3], wherein the housing body (22) has a tubular shape;

wherein the housing body (22) has a first inner space and a second inner space which are divided by the partition portion (23);

wherein the housing body (22) comprises:

a first fitting concave portion (21A, 21B) having the partition portion (23) and a first periphery portion surrounding the first inner space; and a second fitting concave portion (21A, 21B) having the partition portion (23) and a second periphery portion surrounding the second inner space; and wherein end portions of the terminal (31) protruding from the partition portion (23) are disposed in the first fitting concave portion and the second fitting concave portion (21A, 21B) respectively.

[6] The connector according to item [5], wherein the partition portion (23), the first periphery portion, and the second periphery portion are configured by a unitary piece.

[7] A method for producing a connector, comprising:

forming a terminal (31) by cutting an elongated metal conductor subjected to plating with a predetermined length;

press-fitting the terminal (31) into a press-fit hole (25) of a partition portion (23) of a housing body (22) of a housing (21) to fix an intermediate portion of the terminal (31) to the partition portion (23) of the housing body (22), wherein the housing (21) is made of resin and comprises the housing body (22) and the partition portion (23) that divides inside of the housing body (22), and the press-fit hole (25) is provided in the partition portion (23) so as to penetrate the partition portion (23) from a front face to a rear face of the partition portion (23) being opposed to the front face; and filling a seal material into the housing body (22) so as to cover at least one of the front face and the rear face of the partition portion (23), and then the filled seal material is hardened and formed into a seal member (41) and adhered the seal member (41) to the partition portion (23) and the terminal (31) so as to seal the press-fit hole (25).

[8] The method according to item [7], wherein the seal member (41) covers a surface of the partition portion (23), a part of a periphery face of the press-fit hole (25) continuing from the surface of the partition portion (23), and a surface of the plated layer of the terminal (31) facing to the part of the periphery face of the press-fit hole (25).

[9] The method according to item [7] or [8], wherein a fixing protrusion (32,33) is provided on an intermediate portion of the terminal (31) and protrudes outward so that the terminal (31) is fixed to the partition portion (23).

What is claimed is:

1. A connector comprising:

a housing made of resin, the housing comprising:

a housing body; and a partition portion that is provided in the housing body and divides inside of the housing body, a press-fit hole being provided in the partition portion so as to penetrate the partition portion from a front face to a rear face of the partition portion being opposed to the front face;

a terminal having a rod-like shape and comprising a conductive metal portion and a plated layer surrounding the conductive metal portion, the terminal being press-fitted into the press-fit hole, and an intermediate portion of the terminal being fixed to the partition portion; and a seal member configured to cover at least one of the front face and the rear face of the partition portion and adhere to the partition portion and the terminal so as to seal the press-fit hole;

wherein the seal member is formed by a seal material being filled into the housing body and the hardened.

2. The connector according to claim 1, wherein the seal member covers a surface of the partition portion, a part of a periphery face of the press-fit hole continuing from the surface of the partition portion, and a surface of the plated layer of the terminal facing to the part of the periphery face of the press-fit hole.

3. The connector according to claim 1, wherein a fixing protrusion is provided on an intermediate portion of the terminal and protrudes outward so that the terminal is fixed to the partition portion.

4. The connector according to claim 3, wherein the fixing protrusion bites into a periphery face of the press-fit hole.

5. The connector according to claim 1, wherein the housing body has a tubular shape;

wherein the housing body has a first inner space and a second inner space which are divided by the partition portion;

wherein the housing body comprises:

a first fitting concave portion having the partition portion and a first periphery portion surrounding the first inner space; and a second fitting concave portion having the partition portion and a second periphery portion surrounding the second inner space; and wherein end portions of the terminal protruding from the partition portion are disposed in the first fitting concave portion and the second fitting concave portion respectively.

6. The connector according to claim 5, wherein the partition portion, the first periphery portion, and the second periphery portion are configured by a unitary piece.

7. The connector according to claim 1, wherein the terminal includes a pair of fixing protrusions extending outwardly of the terminal in opposite directions such that the protrusions eat into a surface of the press-fit hole.

8. The connector according to claim 1, wherein the seal covers the rear face of the partition portion, wherein the press-fit hole includes a guide portion in an edge portion of the press-fit hole located on the front face of the partition portion, and the guide portion narrows in a direction from the front face and toward the rear face, and wherein the terminal includes a locking dowel that extends outwardly from the terminal, and the locking dowel lies outside of the press-fit hole and is adjacent to the guide portion.

9. A method for producing a connector, comprising:

forming a terminal by cutting an elongated metal conductor subjected to plating with a predetermined length;

press-fitting the terminal into a press-fit hole of a partition portion of a housing body of a housing to fix an intermediate portion of the terminal to the partition portion of the housing body, wherein the housing is made of resin and comprises the housing body and the partition portion that divides inside of the housing body, and the press-fit hole is provided in the partition portion so as to penetrate the partition portion from a front face to a rear face of the partition portion being opposed to the front face;

heating a seal material; and filling the heated seal material into the housing body so as to cover at least one of the front face and the rear face of the partition portion, and then the filled seal material is hardened and formed into a seal member and adhered the seal member to the partition portion and the terminal so as to seal the press-fit hole.

10. The method according to claim 9, wherein the seal member covers a surface of the partition portion, a part of a periphery face of the press-fit hole continuing from the surface of the partition portion, and a surface of the plated layer of the terminal facing to the part of the periphery face of the press-fit hole.

11. The method according to claim 9, wherein a fixing protrusion is provided on an intermediate portion of the terminal and protrudes outward so that the terminal is fixed to the partition portion.

* * * * *